US006341640B1

(12) United States Patent
Iversen et al.

(10) Patent No.: US 6,341,640 B1
(45) Date of Patent: Jan. 29, 2002

(54) METHOD AND ARRANGEMENT FOR CASTING METAL OBJECTS IN CASTING CAVITIES ADAPTED TO BE FILLED UPWARDLY

(75) Inventors: Peter Iversen, Brønshøj; Uffe Andersen, Skævinge, both of (DK)

(73) Assignee: Georg Fischer Disa A/S, Herlev (DK)

( * ) Notice: Subject to any disclaimer, the term of this patent is extended or adjusted under 35 U.S.C. 154(b) by 0 days.

(21) Appl. No.: 09/446,597

(22) PCT Filed: Apr. 21, 1998

(86) PCT No.: PCT/DK98/00160

§ 371 Date: Dec. 22, 1999

§ 102(e) Date: Dec. 22, 1999

(87) PCT Pub. No.: WO99/00202

PCT Pub. Date: Jan. 7, 1999

(30) Foreign Application Priority Data

Jun. 26, 1997 (DK) ..... 0760/97

(51) Int. Cl.[7] ..... B22D 23/00; B22D 18/00; B22D 46/00; B22C 19/04

(52) U.S. Cl. ..... 164/133; 164/155.2; 164/119; 164/457

(58) Field of Search ..... 164/113, 119, 164/285, 284, 363, 359, 362, 66.1, 337, 457, 155.1, 155.2, 154.2, 151.3

(56) References Cited

U.S. PATENT DOCUMENTS

| | | | | |
|---|---|---|---|---|
| 3,566,952 A | | 3/1971 | Wyman | |
| 3,831,662 A | | 8/1974 | Nieman et al. | |
| 4,452,296 A | * | 6/1984 | Amano et al. | 164/363 |
| 4,860,820 A | * | 8/1989 | Pereira | 164/457 |
| 5,246,055 A | * | 9/1993 | Fields et al. | 164/61 |
| 5,636,680 A | | 6/1997 | Mogensen et al. | |
| 5,758,712 A | * | 6/1998 | Pedersen | 164/337 |

FOREIGN PATENT DOCUMENTS

| | | | |
|---|---|---|---|
| EP | 0 234 877 | | 9/1987 |
| GB | 1 601 902 | | 11/1981 |
| GB | 1601902 | * | 11/1981 |
| JP | 262333/94 | | 9/1994 |
| WO | WO-93/11892 A2 | * | 6/1993 |
| WO | 93/22088 | | 11/1993 |

OTHER PUBLICATIONS

"The Making, Shaping and Treating of Steel", McGannon, 1964, United States Steel Corporation, Eighth Edition, pp. 1010–1013.*

* cited by examiner

*Primary Examiner*—M. Alexandra Elve
*Assistant Examiner*—Kevin McHenry
(74) *Attorney, Agent, or Firm*—Larson & Taylor PLC

(57) ABSTRACT

In casting metal objects in casting cavities (2) in moulds (1), connectable to a pressurized mould-filling furnace (5) through a delivery tube (8) and a connector (9), an external riser (13) is connected to and extends upwardly from the junction of the tube (8) and the connector (9). The riser (13) is used as a temporary reservoir in which the level of molten metal is regulated by controlling the gas pressure in space 7 in the furnace (5) such that the filling head, defined as the difference in level between the metal in the casting cavities (2) and that in the external riser (13), is kept constant or made to vary in a desired manner, e.g. so as to cause the level in the cavities to ascend at a substantially constant rate. The invention makes it inter alia possible to produce high-quality aluminum castings in sand moulds, e.g. using automatic foundry equipment of the DISAMATIC® type.

20 Claims, 3 Drawing Sheets

Figure 1:
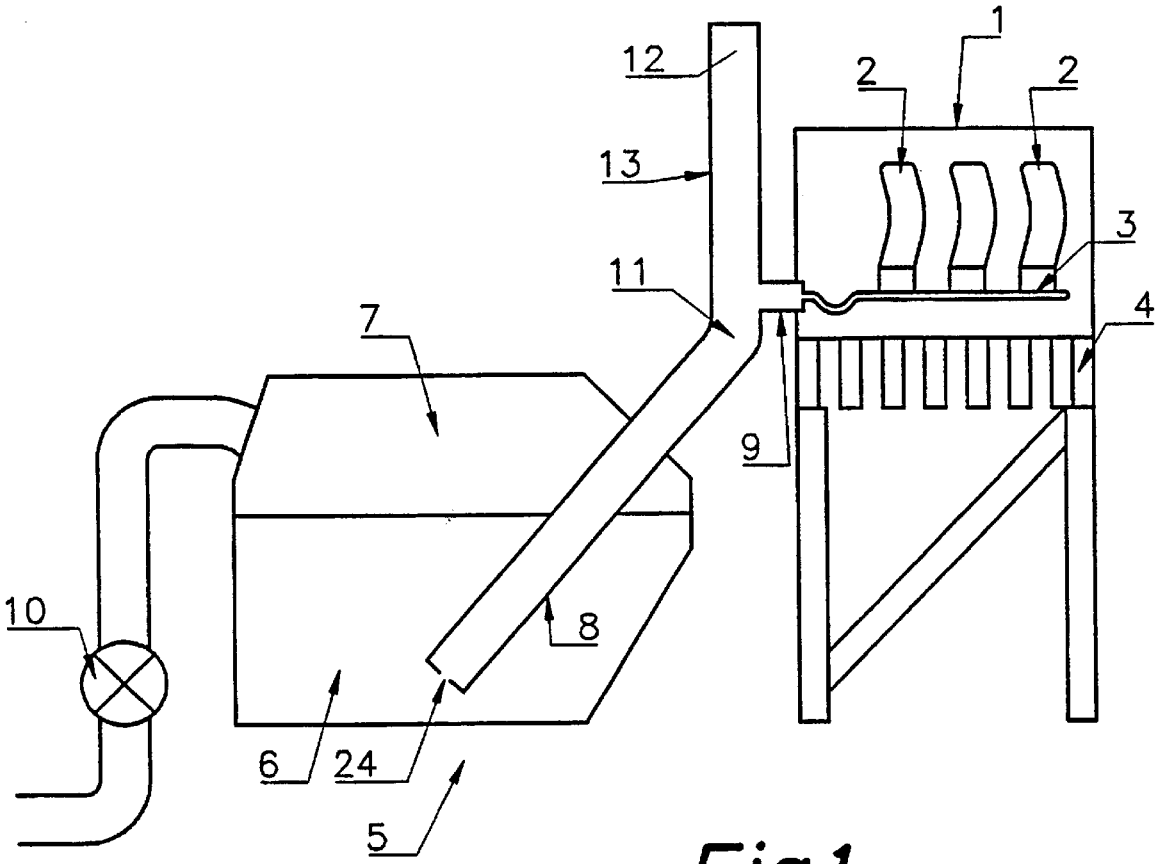

METHOD AND ARRANGEMENT FOR CASTING METAL OBJECTS IN CASTING CAVITIES ADAPTED TO BE FILLED UPWARDLY

FIELD OF THE INVENTION

The present invention relates to a method of casting metal objects in moulds and to an arrangement for carrying out the method. The method and arrangement are of the kind (a) which provides a mould having at least one casting cavity with a filling duct opening into the lowermost part thereof; (b) which provides a supply of molten metal to the cavity with a sufficient pressure to be able to rise at least to the uppermost part of the casting cavity; and (c) which connects the supply to the filling duct allowing the molten metal to fill the casting cavity or cavities by ascending to the uppermost limit(s) thereof.

BACKGROUND ART

In recent years, manufacturers of cast articles have expressed a desire to be able to cast articles of aluminium or its alloys using a more adaptable technology than that available with conventional die-casting techniques. As it is widely known that the use of disposable sand moulds allows for far greater flexibility and adaptability than conventional die casting, this desire has focussed the attention on the use of sand moulds for casting aluminium objects. This has already been done for some time, but generally only for casting objects having relatively large cross-section, as attempts to cast thin-walled objects have in most cases proved unsuccessful.

It was found at relatively early stage that it would in any case be necessary to use casting cavities of the type being filled from below, as filling from the top invariably caused undesirable splashing leading to oxidation and formation of highly unpleasant slag in the form of "beard", and there could even be a risk of explosion caused by a chemical reaction between the aluminium and moisture in the mould, liberating hydrogen that could form an explosive mixture with any air present.

Further, when thus having decided to use moulds with casting cavities to be filled from below, it was found that the rate, at which the molten metal enters the casting cavities, was a highly critical parameter. Thus, a too low rate could not ensure that the mould was filled "in time", i.e. before the metal began to solidify in the casting cavities, whereas a too high filling rate could cause turbulence, facilitating oxidation and entailing a risk of mechanical damage to the walls of the casting cavities.

DISCLOSURE OF THE INVENTION

It is the object of the present invention to provide a method of the kind referred to initially, with which it is possible to avoid the difficulties explained above and to make it possible to use disposable sand moulds for producing problematic castings, such as thin-walled articles of aluminum or its alloys. This object is achieved by, according to the invention, in that the connecting and filling step comprises the steps of (a) connecting the supply and the filling duct to an external riser extending upwardly to a higher level than the uppermost limit of the casting cavity or cavities and capable of temporarily containing a quantity of the molten metal, and (b) allowing the molten metal in the external riser to ascend toward the higher level at least until the casting cavity or cavities is/are completely filled with molten metal. By so doing, it is possible to achieve close control of the rate, at which the casting cavities are filled with molten metal, as the external riser acts as a "pressure buffer" preventing both too high and too low filling rates.

The present invention also relates to an arrangement for carrying out the method of the invention. This arrangement includes (a) a supporting means for temporarily supporting a mould having at least one casting cavity, the lowermost part of each such cavity communicating with a filling duct, at least one end of which is open to the outside of the mould, b) a mould-filling means adapted to contain molten metal and to transfer the latter under a controlled pressure to the filling duct, being temporarily connectable to the latter through a coupling means adapted to engage the filling-duct open end in a liquid-tight manner, and c) an external riser means communicating with the coupling means and in the filling position of the mould extending upwardly to a higher level than the uppermost limits of the casting cavity or cavities. As will be explained in the following detailed part of the present description, such an apparatus is suitable for carrying out the method.

Further advantageous embodiments of the method and the arrangement, the effects of which will be evident from the following detailed part of the present description, are set forth hereinafter.

DESCRIPTION OF THE PREFERRED EMBODIMENTS

Figure 2:
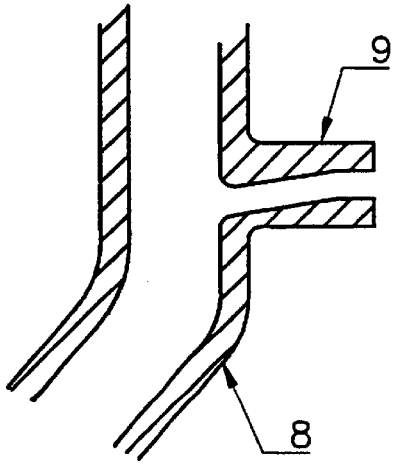
Figure 3:
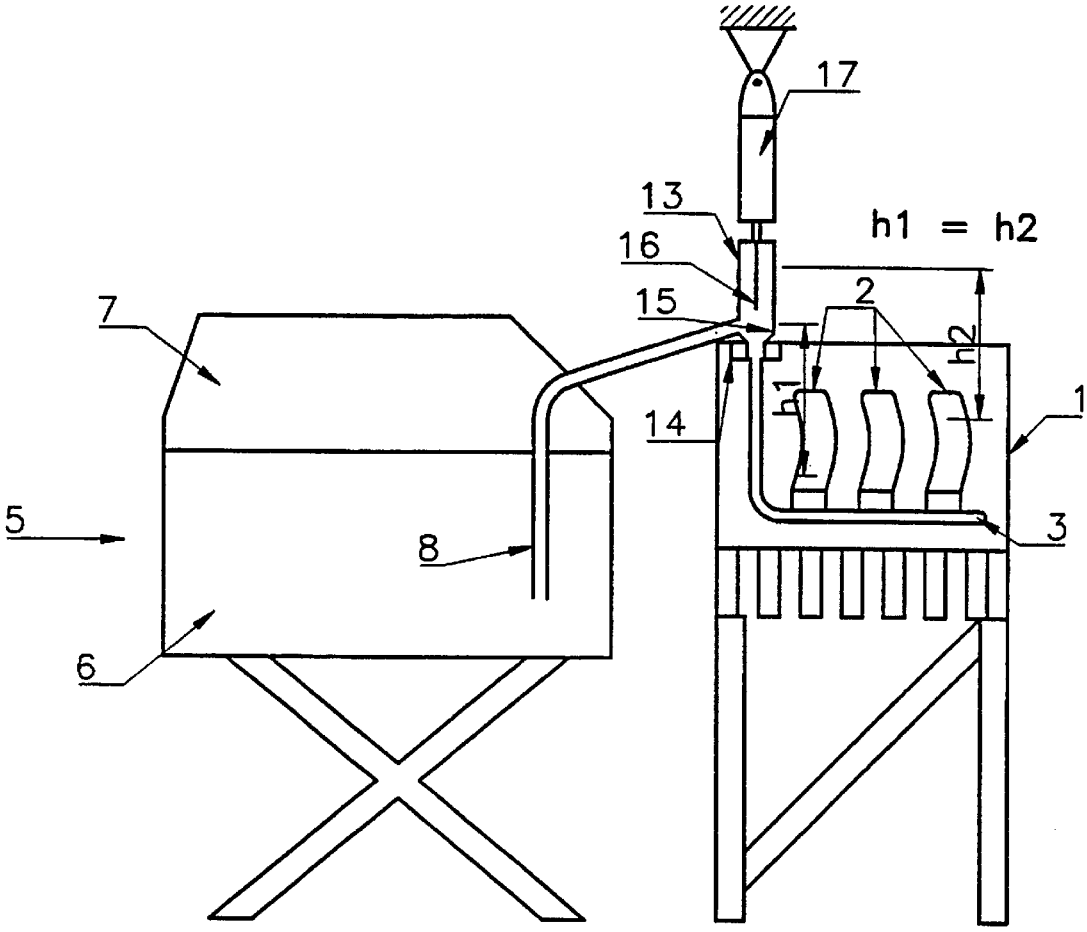
Figure 4:
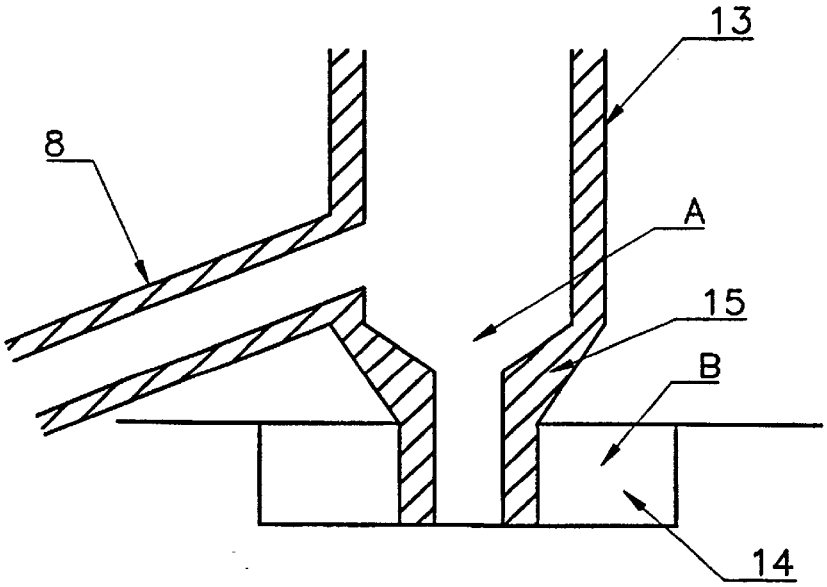
Figure 5:
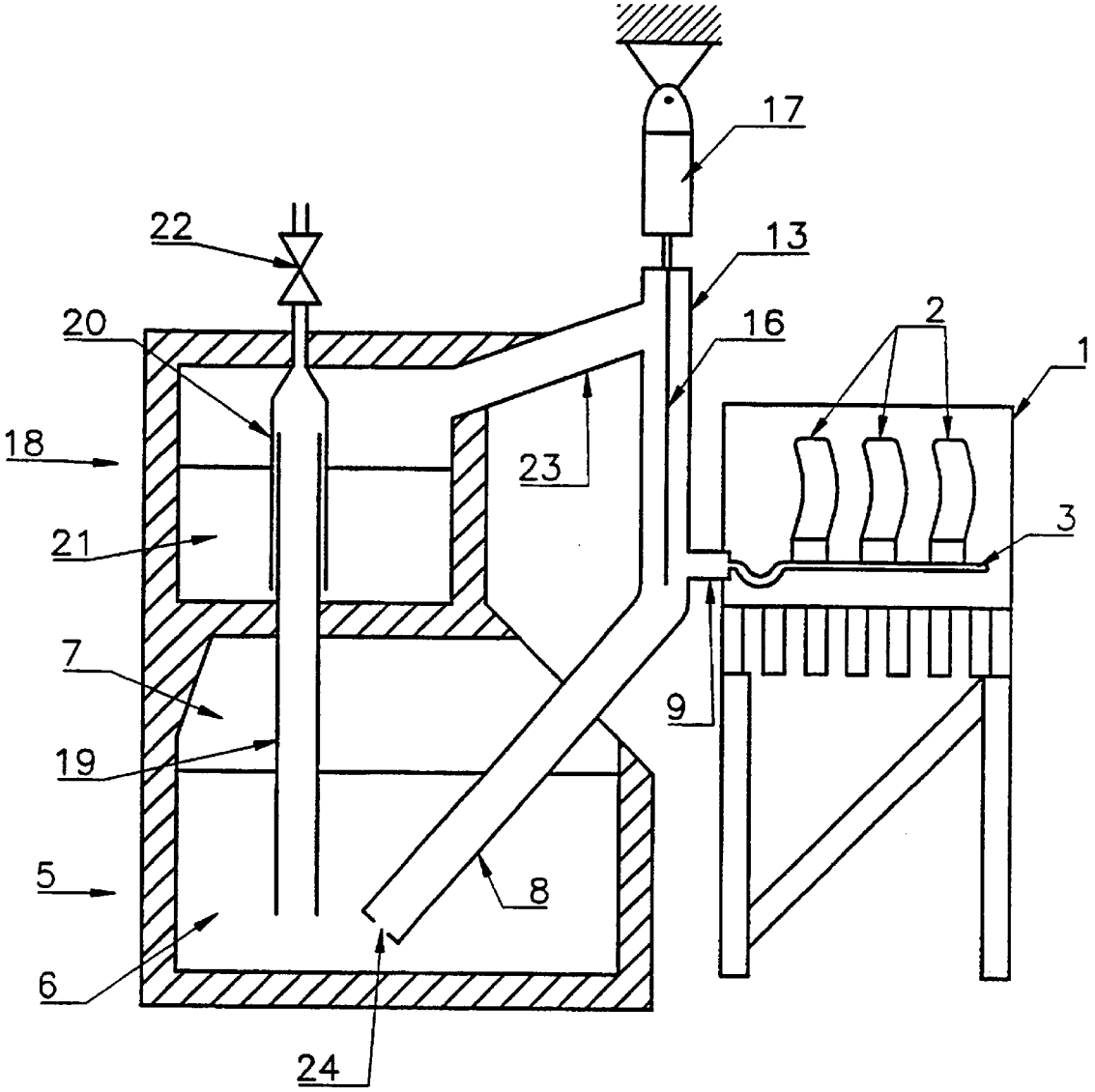

In the following detailed part of this description the invention will be explained in more detail with reference to the exemplary embodiments of arrangements according to the invention shown in a highly simplified and diagrammatic manner in the drawings, of which FIG. 1 shows a first exemplary embodiment of an arrangement comprising a mould-filling furnace adapted to fill casting cavities in moulds comprised by a mould string advanced on a conveyor, FIG. 2 at an enlarged scale shows a detail of the arrangement of FIG. 1, FIG. 3 shows a second exemplary embodiment of an arrangement, differing from that of FIG. 1 by the manner of connecting to the moulds, FIG. 4 at an enlarged scale shows a detail of the arrangement of FIG. 3, and FIG. 5 shows an arrangement comprising a melting furnace.

DESCRIPTION OF THE PREFERRED EMBODIMENTS

The mould-filling station shown in FIG. 1 accommodates a mould 1, in the example shown having three identically shaped casting cavities 2, the lowermost parts of which communicate with a common filling duct 3.

The mould 1 is one of a number of similar moulds being advanced by a conveyor 4 in a direction transverse to the plane of the drawing in the form of a "string" of moulds.

A mould-filling furnace 5 contains a quantity of molten metal 6, being acted upon by the pressure of a gas, that may be compressed air, in an upper space 7. When a mould 1 is to be filled with molten metal, the pressure in the upper space 7 is increased so as to cause the metal to flow upwardly through a delivery tube 8 having a spout 9 temporarily inserted sealingly into the common filling duct 3, so that metal will flow into the casting cavities 2 and ascend to the uppermost limits of the latter.

The gas pressure in the space 7, and hence the pressure, with which the molten metal is made to flow towards the casting cavities 2, is controlled by a PLC-controlled valve 10, in turn controlled by a control unit (not shown) adapted inter alia to receive and interpret signals from two sensors 11 and 12 placed in an external riser 13 in the form of a tube communicating with the filling tube 8.

The mould-filling furnace 5 and the filling tube 8 with the spout 9 as well as the external riser 13 are, of course, suitably heated and/or thermally insulated to keep the metal in them in the molten state. The requisite means for heating and/or insulation are not shown, but any person with a knowledge of furnace and foundry practice will know how to provide them, for which reason they will not be described in the present description.

The external riser 13 acts as a temporary reservoir for metal being supplied through the delivery tube 8, thus receiving "surplus" metal not flowing through the spout 9 due to the flow resistance of the latter and/or that of the filling duct 3 and/or of the casting cavities 2 proper.

During the process of filling the casting cavities 2 through the spout 9 and the filling duct 3, the metal in the external riser 13 will ascend at a velocity depending on the flow resistances concerned as well as the gas pressure in the upper space 7 of the mould-filling furnace 5.

By using a suitable programme installed in the control unit (not shown) controlling the PLC-controlled valve 10, it is possible to make the metal in the external riser 13 ascend at such a rate, that the filling-pressure head, defined as the difference in surface level between the metal in the external riser 13 and that in the casting cavities 2, will either be constant or follow a predetermined head/time function selected with a view to achieving an optimum filling process for the cavities 2.

If the flow cross-sectional area of the casting cavities 2 varies along their vertical dimension, the head/time function could be such that the ascension rate is substantially constant, thus avoiding turbulence in narrow parts while ensuring a reasonably speedy filling of the wider parts. Other functions are, of course, possible.

The lower sensor 11 can advantageously be adapted to sense the absence or presence of molten metal, and in the latter case to actuate the control unit (not shown) to initiate the programme controlling the pressure in the upper space 7. The upper sensor 12 may be used to signal the pressure of molten metal in the top of the external riser 13 to the control unit, the latter then—after a suitable interval to ensure that the casting cavities 2 have been filled and the inlet gate has been closed, vide WO9532826—initiating a terminating process of reducing the pressure in the upper space 7 so as to make the level of molten metal fall below the spout 9, disengaging the latter from the mould 1 and moving the mould to a succeeding work station, and then moving a new mould into position and bringing the spout 9 into engagement with it.

As may be seen from FIG. 2, the duct inside the spout 9 is inclined upwardly from its connection to the delivery tube 8 to its exit point. The purpose of this is to allow molten metal to flow back into the delivery tube 8, when the casting cavities 2 concerned have been filled and the level of metal in the assembly consisting of the delivery tube 8, the spout 9 and the external riser 13 is being lowered as part of the terminating process referred to above.

FIG. 3 shows a mould-filling station with a mould-filling furnace 5 having a delivery tube 8, adapted to deliver molten metal 6 along the delivery tube 8 in substantially the same manner as that described above with reference to FIG. 1. One important difference is, however, that in the mould 1 with casting cavities 2, the common filling duct 3 extends from a cup 14 in the top of the mould. This makes it necessary to use a different type of means for temporarily connecting the delivery tube 8 and the external riser 13 to the filling duct 3.

Thus, the cup 14 is adapted to temporarily receive the lower spigot end 15 of the external riser 13, cf. also FIG. 4, in a substantially liquid-tight manner. As shown in FIG. 4, the volume A of said spigot 15 below the connection to the delivery tube 8 should not be greater than the volume B of the cup 14, in order to avoid overflowing when the filling process is terminated and the spigot 15 disengaged from the cup 14.

Another feature of the mould-filling station shown in FIG. 3 is a metal-level sensor 16 adapted to be moved vertically by a pneumatic cylinder 17, these two components 16 and 17 co-operating with the control unit (not shown), e.g. in a manner to ensure a substantially constant filling head $h_1=h_2$ during the process of filling the mould cavities 2. In this example also, the above-mentioned programme providing a substantially constant ascension rate could be used by suitably adapting the sensor 16 and the cylinder 17 to the control programme.

In large-scale mass production of castings, a considerable volume of metal is consumed per unit of time. This means, of course, that the mass of molten metal 6 will have to be replenished from time to time. In the exemplary embodiments shown in FIGS. 1 and 3, this would make it necessary to open the mould-filling furnace 5, thus interrupting its normal operation due to the loss of gas pressure in the upper space 7.

The exemplary embodiment shown in FIG. 5 makes it possible to achieve uninterrupted operation of the mould-filling furnace 5 while allowing it to be replenished at suitable intervals. This is achieved by placing a melting furnace 18 at a higher level than, preferably on top of, the mould-filling furnace 5, and connecting the latter to the former by means of a siphon tube 19 with the siphon part 20 entirely within the melting furnace 18, the latter being adapted to be opened from time to time in a manner not shown in order to replenish its quantity of molten metal 21 by introducing additional metal in the solid or liquid state (not shown), if necessary heated by means of suitable heating means (likewise not shown).

The siphon part 20 is connected to atmosphere through a breathing valve 22, and when the latter is closed, the former functions as a normal siphon, transferring molten metal 21—provided its level is high enough—to the mould-filling furnace 5. When a substantial proportion of the molten metal 21 has flowed from the melting furnace 18 to the mould-filling furnace 5—this can be ascertained by suitable sensing means (not shown)—the breathing valve 22 is opened to interrupt the siphoning effect. The mould-filling furnace 5 remains dosed to the atmosphere during the whole of this transfer process, allowing normal operation as described above, because—provided that the breathing valve 22 has been opened at the correct level of the molten metal 21 and again closed—the siphon part 20 will co-operate with the molten metal to form a liquid seal preventing loss of pressure in the upper space 7 of the mould-filling furnace 5.

In the exemplary embodiment shown in FIG. 5, an overflow tube 23 extends from the top of the external riser 13 to the inside of the melting furnace 18, to act as a safety relief in case of malfunctioning of the components having influence upon the level of liquid metal in the external riser 13.

In the exemplary embodiments shown in FIGS. 1 and 5, the lower end of the delivery tube 8 is provided with a restricted inflow aperture 24 capable of limiting the rate as measured in units of volume per unit of time, at which the molten metal flows through the delivery tube 8. This aperture 24 can also act as a safety measure in cases of malfunctioning of control components and/or programmes.

In these same embodiments, the vertically movable sensor 16 is adapted to be moved by a pneumatic cylinder 17. It will be understood, however, that the cylinder 17 may be replaced by any other kind of suitable linear actuator.

The external riser 13 may be open at the top, or adapted to be closed at the top by means of a suitable valve (not shown). In the latter case, the increase in pressure in the air or gas in the top of the riser caused by the ascending volume of metal may be utilized to reduce the requisite height of the column, as a part of the pressure head will be provided by said air or gas pressure. Such an arrangement would, of course, necessitate changes in the control unit (not shown) and/or in the programmes installed in it.

What is claimed is:

1. A method of casting metal objects in moulds, said method comprising the steps of:

a) providing a mould having at least one casting cavity with a filling duct opening into a lowermost part of said casting cavity, b) providing a supply of molten metal with a sufficient pressure to be able to rise at least to an uppermost part of said casting cavity, c) connecting said supply to said filling duct and allowing said molten metal to fill said casting cavity or cavities by ascending to the uppermost part(s) thereof, said connecting step comprising the steps of c1) connecting said supply and said filling duct to an external riser extending upwardly to a higher level than the uppermost part of said casting cavity or cavities and capable of temporarily containing a quantity of said molten metal, c2) allowing said molten metal in said external riser to ascend toward said higher level at least until said casting cavity or cavities is/are completely filled with molten metal, c3) sensing a rising of said molten metal in said external riser, and c4) controlling the pressure of said molten metal in the supply in response to the sensed rising of said molten metal such that the external riser acts as a pressure buffer preventing both too high and too low filling rates.

2. A method according to claim 1, wherein said controlling step is carried out such that a surface level of molten metal in each casting cavity ascends at a rate which is a predetermined function of an expected or actual instantaneous position of said surface level.

3. An arrangement for casting metal objects in moulds comprising:

a) a supporting means for temporarily supporting a mould having at least one casting cavity, a lowermost part of each said cavity communicating with a filling duct, an open end of said filling duct being open to the outside of said mould, b) a mould-filling means for containing a molten metal and for transferring the molten metal under a controlled pressure to said filling duct, said mould-filling means being temporarily connectable to said filling duct through a coupling means adapted to engage the open end of said filling-duct in a liquid-tight manner, c) an external riser means for communicating with said coupling means and, in a filling position of said mould, for extending upwardly to a higher level than uppermost parts of said casting cavity or cavities, d) a sensing means for sensing a rising of said molten metal in said external riser, and e) a controlling means for controlling the pressure of said molten metal in said mould-filling means in response to the sensed rising of said molten metal such that the external riser acts as a pressure buffer preventing both too high and too low filling rates.

4. An arrangement according to claim 3, wherein said filling-duct open end is directed substantially horizontally, and wherein said coupling means comprises a duct inclined downwardly away from its point of engagement with said open end.

5. An arrangement according to claim 3, wherein said filling duct open end is directed substantially vertically upwards, opening into a cup, wherein said coupling means comprises a substantially vertical duct extending downwardly from a junction of said external riser means and a delivery duct leading from a supply of the molten metal and having a duct volume not greater than a volume of said cup.

6. An arrangement according to claim 3, wherein said mould-filling means comprises a mould-filling furnace with an enclosure for containing the molten metal, and wherein said controlling means is a gas-pressure applying means for applying gas pressure to a surface of said molten metal so as in a controlled manner to make said metal flow through a delivery duct towards said coupling means, said gas-pressure applying means comprising a PLC-controlled valve in a conduit leading from a source of pressurized gas to said enclosure, said valve being controlled by a control unit adapted to receive and interpret signals from at least one sensor placed in said external riser means and adapted to sense the presence or absence of liquid metal and/or the position of the surface level of the liquid metal.

7. An arrangement according to claim 3, wherein the top of said external riser is open to the atmosphere.

8. An arrangement according to claim 3, wherein the top of said external riser is connected to the atmosphere through a valve.

9. An arrangement according to claim 3, further comprising a melting furnace adapted to be opened to allow the introduction of additional solid or liquid metal and having a heating means to heat said metal to the desired temperature above melting point, said furnace being situated at a higher level than said mould-filling means and connected to the mould-filling means through a siphon tube, a siphon part of said siphon tube being situated within said melting furnace and connectable to the atmosphere through a siphon valve in a manner to interrupt the siphoning function.

10. An arrangement according to claim 9, further comprising an automatic means adapted to open said siphon valve upon the surface of the molten metal in said melting furnace having descended to a predetermined level, at which the molten metal co-operates with said siphon part to form a liquid seal capable of withstanding the highest gas pressure expected to reign in said enclosure in said mould-filling furnace.

11. An arrangement according to claim 9, further comprising an overflow duct leading from a top of said external riser means to said melting furnace.

12. An arrangement according to claim 3, further comprising a restricted inflow aperture in a delivery duct leading from said molten metal in said mould-filling means to said coupling means.

13. An arrangement for casting metal objects in moulds comprising:

a) a supporting means for temporarily supporting a mould having at least one casting cavity, a lowermost part of each said cavity communicating with a filling duct, an open end of said filling duct being open to the outside of said mould, b) a mould-filling means for containing a molten metal and for transferring the molten metal under a controlled pressure to said filling duct, said mould-filling means being temporarily connectable to said filling duct through a coupling means adapted to engage the open end of said filling-duct in a liquid-tight manner, c) an external riser means for communicating with said coupling means and, in a filling position of said mould, for extending upwardly to a higher level than uppermost parts of said casting cavity or cavities, and d) a melting furnace adapted to be opened to allow the introduction of additional solid or liquid metal and having heating means to heat said metal to the desired temperature above melting point, said furnace being situated at a higher level than said mould-filling means and connected to the latter through a siphon tube, a siphon part of said siphon tube being situated within said melting furnace and connectable to the atmosphere through a siphon valve in a manner to interrupt the siphoning function.

14. An arrangement according to claim 13, wherein said filling-duct open end is directed substantially horizontally, and wherein said coupling means comprises a duct inclined downwardly away from its point of engagement with said open end.

15. An arrangement according to claim 13, wherein said filling duct open end is directed substantially vertically upwards, opening into a cup, wherein said coupling means comprises a substantially vertical duct extending downwardly from a junction of said external riser means and a delivery duct leading from a supply of the molten metal and having a duct volume not greater than a volume of said cup.

16. An arrangement according to claim 13, further comprising a gas-pressure applying means for applying gas pressure to a surface of said molten metal in said mould-filling means so as in a controlled manner to make said metal flow through a delivery duct towards said coupling means, said gas-pressure applying means comprising a PLC-controlled valve in a conduit leading from a source of pressurized gas to said enclosure, said PLC-controlled valve being controlled by a control unit adapted to receive and interpret signals from at least one sensor placed in said external riser means and adapted to sense the presence or absence of liquid metal and/or the position of the surface level of the liquid metal.

17. An arrangement according to claim 13, wherein the top of said external riser is open to the atmosphere.

18. An arrangement according to claim 13, wherein the top of said external riser is connected to the atmosphere through a valve.

19. An arrangement according to claim 13, further comprising an automatic means adapted to open said siphon valve upon the surface of the molten metal in said melting furnace having descended to a predetermined level, at which the molten metal co-operates with said siphon part to form a liquid seal capable of withstanding the highest gas pressure expected to reign in said enclosure in said mould-filling furnace.

20. An arrangement according to claim 13, further comprising an overflow duct leading from a top of said external riser means to said melting furnace.

* * * * *